US009345922B2

(12) United States Patent
Allison et al.

(10) Patent No.: US 9,345,922 B2
(45) Date of Patent: May 24, 2016

(54) STRENGTH TRAINING SYSTEM AND METHOD HAVING ELASTIC RESISTANCE AND SUSPENSION DEVICES

(71) Applicants: Kasper Allison, Santa Barbara, CA (US); Shane Cervantes, Santa Barbara, CA (US)

(72) Inventors: Kasper Allison, Santa Barbara, CA (US); Shane Cervantes, Santa Barbara, CA (US)

( * ) Notice: Subject to any disclaimer, the term of this patent is extended or adjusted under 35 U.S.C. 154(b) by 618 days.

(21) Appl. No.: 13/652,415

(22) Filed: Oct. 15, 2012

(65) Prior Publication Data

US 2013/0190148 A1 Jul. 25, 2013

Related U.S. Application Data

(60) Provisional application No. 61/704,122, filed on Sep. 21, 2012, provisional application No. 61/688,022, filed on May 7, 2012, provisional application No. 61/632,302, filed on Jan. 23, 2012.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/068*** | (2006.01) |
| ***A63B 21/16*** | (2006.01) |
| ***A63B 23/035*** | (2006.01) |
| *A63B 21/02* | (2006.01) |

(52) U.S. Cl.

CPC ..... *A63B 21/0442* (2013.01); *A63B 21/00061* (2013.01); *A63B 21/00065* (2013.01); *A63B 21/0552* (2013.01); *A63B 21/068* (2013.01); *A63B 21/16* (2013.01); *A63B 21/169* (2015.10); *A63B 21/1645* (2013.01); *A63B 21/1663* (2013.01); *A63B 21/4035* (2015.10); *A63B 21/4043* (2015.10); *A63B 23/03541* (2013.01); *A63B 21/023* (2013.01); *A63B 2209/10* (2013.01)

(58) Field of Classification Search

CPC ..... A63B 21/00
USPC ..... 482/904, 907, 121, 126
See application file for complete search history.

(56) References Cited

U.S. PATENT DOCUMENTS

| | | | |
|---|---|---|---|
| 4,909,505 | A | 3/1990 | Tee |
| 5,209,712 | A | 5/1993 | Ferri |
| 5,813,954 | A | 9/1998 | Wilkinson |
| 6,113,564 | A | 9/2000 | McGuire |
| 6,561,956 | B1 | 5/2003 | Allison |
| 6,652,419 | B1 | 11/2003 | Rota |
| 6,921,354 | B1 | 7/2005 | Shifferaw |
| 6,941,620 | B1 | 9/2005 | Hinds |

(Continued)

*Primary Examiner* — Jerome W Donnelly
(74) *Attorney, Agent, or Firm* — Thomas A. Runk; Fulwider Patton LLP

(57) ABSTRACT

A strength training system and method includes an inelastic base strap connecting with an anchor and connecting with elastic/static components, which in turn are connected with handles. The combination of an inelastic base strap with modular elastic/static components configurable to be either elastic or inelastic provides the ability to perform suspension training as well as elastic band training with the same system. The elastic/static components may quickly be converted from an elastic to an inelastic segment by simply disconnecting the elastic module or by simply connecting the inelastic segment, since it is shorter than the elastic module. The elastic module includes a plurality of connectable elastic bands and may easily be replaced with other modules. An anchor point device is disclosed having double opposing cam buckles, usable with a door.

19 Claims, 11 Drawing Sheets

(56) References Cited

U.S. PATENT DOCUMENTS

| | | | | |
|---|---|---|---|---|
| 6,971,334 | B1 | 12/2005 | Livesay et al. | |
| 7,044,896 | B2 | 5/2006 | Hetrick | |
| 7,090,622 | B2 | 8/2006 | Hetrick | |
| 7,192,389 | B2 | 3/2007 | Allison | |
| 7,291,099 | B1 | 11/2007 | Marczewski | |
| 7,651,448 | B2 | 1/2010 | Hetrick | |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| D636,036 | S | 4/2011 | Rios | |
| 8,007,413 | B1 * | 8/2011 | Wu | 482/91 |
| 8,043,197 | B2 | 10/2011 | Hetrick | |
| 8,197,392 | B2 * | 6/2012 | Silverman et al. | 482/91 |
| 8,696,530 | B2 * | 4/2014 | Eubanks | 482/121 |
| 2002/0022555 | A1 | 2/2002 | Nesci | |
| 2005/0085350 | A1 | 4/2005 | Shen | |
| 2007/0027005 | A1 * | 2/2007 | Hetrick | 482/91 |
| 2007/0173383 | A1 | 7/2007 | Feigenbaum et al. | |
| 2011/0111929 | A1 | 5/2011 | Allison et al. | |
| 2012/0053027 | A1 | 3/2012 | Hetrick | |

* cited by examiner

STRENGTH TRAINING SYSTEM AND METHOD HAVING ELASTIC RESISTANCE AND SUSPENSION DEVICES

BACKGROUND

The present invention relates to strength training, and more particularly, to a strength training system and method having configurable elastic and inelastic straps providing resistance for use in performing a wider variety of strengthening exercises.

Strength training is the use of a resistance to oppose muscular contraction or extension to build the strength, anaerobic endurance, and size of skeletal muscles. There are many different methods of strength training, the most common being the use of gravity to oppose muscle movement. For example, the simple "push up," where a person lies face down against a surface and pushes himself/herself upward against gravity (which is exerting a downward force against the exerciser), is a resistance training method. The weight of the exerciser's body and the pull of gravity provide the "resistance" useful to strengthen the arm muscles, and other muscles.

Strength training is highly beneficial to individuals and many people desire to engage in such training on a daily basis. Strength training can provide significant improvement in the health and well-being of those who perform it including increased bone density, muscle tone, and strength, and improved joint function. Muscles, tendons, and ligaments can all be strengthened and doing so reduces the potential for injury. The exerciser will enjoy an improved sense of self-confidence, improved cardiac and respiratory functions, as well as many other enhancements both physical and mental.

Resistance training is a form of strength training in which each effort is performed against a specific opposing force (i.e. resistance to being pushed, squeezed, stretched, or bent). Exercises are isotonic if a body part is moving against the force. Exercises are isometric if a body part is holding still against the force. Resistance exercise is used to develop the strength and size of skeletal muscles.

The goal of resistance training, according to the American Sports Medicine Institute (ASMI), is to "gradually and overload progressively the musculature system so it gets stronger." Research shows that regular resistance training will strengthen and tone muscles and increase bone mass. Resistance training should not be confused with weightlifting, powerlifting or bodybuilding, which are competitive sports involving different types of strength training with non-elastic forces such as gravity (weight training). Full range of motion is important in resistance training because muscle overload occurs only at the specific joint angles where the muscle is worked.

Weight training devices and systems have been available for years. Most however include dumbbells or barbells that are either fixed weights or are configured for selectable weights, such as disks, that may be clamped on the ends to make the device heavier or removed to make the device lighter. There are many other types of machines that have selectable weights, cables, bars, and other devices that have been highly engineered and designed to focus weight training exercises on certain muscles or muscle groups. Many such machines are superbly designed and are excellent in building an exerciser's strength. However, many people who would like to perform strength training exercises do not have access to such machines. Many exercisers need smaller more versatile exercising devices or systems that can be easily used at home or taken on trips, installed for use, and uninstalled.

Weight and resistance training provide the majority of the resistance at the initiating joint angle of the relevant muscle when the movement begins, when the muscle must overcome the inertia of the weight's mass (however, if repetitions are performed extremely slowly, inertia is never overcome and resistance remains constant). In contrast, elastic resistance provides the greatest opposition to contraction at the end of the movement when the material experiences the greatest tension while hydraulic resistance varies depending on the speed of the submerged limb, with greater resistance at higher speeds. In addition to the equipment used, joint angles can alter the force output of the muscles due to leverage.

Resistance exercise devices allow a user to exercise by providing a resistance to the movement of a user's arms, legs, or torso. Resistance is normally provided by working one muscle against another, or against gravity. One presently-used system in which gravity plays the main role is known as "rope training" or suspension training Suspension training or suspension exercising is not used in the trademark sense herein. Whenever "suspension training" is mentioned, it is meant to refer only to suspending the exerciser for the purpose of strength training. It is not meant to refer to any particular company products or sponsored exercise routines of any company or trademark owner.

This form of exercise and equipment for suspension training or exercising involves an apparatus made of nylon or other relatively inelastic straps with handles. The exerciser can attach a strap or straps to a sturdy anchor at a wide variety of locations, such as in the exerciser's home. One commonly used anchor is a door jam. The exerciser then uses his or her body weight supported in the straps as the resistance to perform exercises that build strength, core stability, flexibility, and balance. The basic concept is that the exerciser mounts a pair of specifically-designed straps to the anchor and then performs various exercises that use only the exerciser's own body weight as resistance. This form of exercise has become quite popular recently since it is quite portable and can provide a good workout of core muscles.

The "core" is not meant to be restrictive as used herein. In some cases, the "core" is defined as the abdominal muscles groups (transverse abdominis, internal obliques, external obliques, rectus abdominis), hip abductors/adductors, hip flexors, and the lumbar spine. However, others may consider the "core" to refer to additional or fewer muscles or groups of muscles and/or anatomical tissues.

Another type of resistance exercise device provides an inelastic strap that is attachable to a fixed location or "anchor" such as, for example, a door. These devices may overcome some of the limitations of the elastic devices previously discussed by providing inelastic straps that can be anchored between a door and a doorjamb, door head, or other part of a door frame. FIG. 1 presents a view of a prior art suspension exercising device 30 that uses the door 32 as an anchor and has two strap segments 34 and 36 for suspension of the user 38. It is shown that the user has engaged the handles, only one of which is shown 40 of the two suspension strap segments with respective hands, leaned back to suspend himself against gravity, and is pulling himself towards the handles using arm muscles. An anchor strap 42 is located between the top 44 of the door 32 and the frame 46 of the door with an anchor loop 48 located at the inside end of the anchor strap and protruding at the top of the door for receiving the base suspension strap 50, the loop effectively dividing the base suspension strap into the two suspension strap segments 34 and 36. Each suspension strap segment includes an adjusting buckle 52 and 54 respectively to allow the user to shorten or lengthen each suspension strap segment. The door provides a sturdy anchor location that will support the weight of a user. In this case, all straps are inelastic.

Other suspension-type exercising devices have a fixed length strap attached to a door through a pulley system that allows the user to exercise by moving the arms in opposite directions. Both of the suspension devices shown in FIG. 1 and the pulley type are of limited usefulness because of their fixed length and the limited range of exercises for which they can be used. Other types of anchors are available. FIG. 2 is a view of a commercially-available fixed anchor through which a suspension strap may be threaded or to which an anchor loop may be attached through which a strap may be threaded for use by a user. In this case, the anchor would be bolted to a wall, or post, or other structure suitable to hold the entire weight of the user of the exercise straps.

However, suspension training systems do not efficiently provide a means for a user to perform certain strength training exercises, such as ground-based movements (standing), progressive resistance movements, and weighted lower body movements. All of these exercises can be quite helpful in strength conditioning and training.

Other exercise equipment in the resistance training realm includes elastic straps or bands to provide an increased resistance force. The usefulness of these devices depends, in part, on the ease with which an exerciser can perform different types of exercises, the range or number of exercises that can be performed with the device, and the ease with which different exercisers can adjust the device according to their height, weight, strength, and/or physical limitations. As used herein, the words "strap" and "band" are meant to be used interchangeably and are synonymous, for convenience of description.

Resistance exercise devices having elastic straps typically restrict the motion of a user's arms and/or legs, or the motion between the user and a support structure. Elastic exercise devices can be small, even portable, but have limited usefulness that result from their resistance characteristics, which depend on the length and elasticity of the elastic strap. As a result of these characteristics, the elastic straps are useful for a specific length range, thus restricting the diversity of exercises for which it can be used. In addition, it may not be possible for different users to employ the same device for the same exercise due to differences in height, weight, or strength between different users. Thus, for an elastic device to be generally useful, such as to provide a complete workout or to allow for use by different users, a plurality of elastic straps having different lengths are required that must be easily interchangeable. To the knowledge of the inventor, no known prior art device provides the ease of use necessary to be generally useful across a wide range of exercises.

Another limitation of elastic resistance exercise devices is that the resistance is inconsistent and increases with increasing displacement, and also tends to snap back when the user decreases his or her effort. While this resistance response provides for a compact design, it is problematic as it does not recreate the resistance encountered by muscles during more natural types of exercising, such as running, swimming, and others. Yet another limitation of elastic devices is the inability to support a wide range of weight of the user. Typically the devices are adapted to support only the resistance provided by the user's muscles. This creates extreme limitations in the exercises that can be performed by any individual elastic device. For this reason, elastic devices must be used over a limited range of stances, further limiting the user's workout.

Hence those skilled in the art have recognized a need for a strength training device that is easily adjustable so that it can provide a complete workout for any user, including adjustments that allow a wide range of stances and exercises, and that provides resistance to the user's motion in a form that is useful for exercising. In addition, there is a need to provide such a device that is adaptable to be easily portable to enable the device to be mounted to different locations for exercising. A further need has been recognized for a strength training system that has suspension training elements and elastic training elements combined in an easily usable and effective manner to provide the ability to perform a wider variety of exercises. The present invention fulfills these needs and others.

SUMMARY OF THE INVENTION

Briefly and in general terms, there is provided a system and method for strength training using elastic resistance and suspension devices. In particular, there is provided a strength training system for conditioning the strength of a user through the use of a strap connected with an anchor, the training system comprising a first user handle configured to receive a body part of a use, an elongated suspension base strap formed of inelastic material, the suspension base strap having an end, an elastic/static component having a first end and a second end, the elastic/static component comprising an inelastic segment selectively connectable to the first end and the second end of the elastic/static component, and an elastic segment selectively connectable to the first end and the second end of the elastic/static component, wherein either one or the other of the inelastic segment and elastic segment may be connected to the first and second ends of the elastic/static component and when only the inelastic segment is connected to the first and second ends of the elastic/static component, the elastic/static component is inelastic, and wherein when only the elastic segment is connected to the first and second ends of the elastic/static component, the elastic/static component is elastic, wherein the suspension base strap and the elastic/static component are connected together end to end with an end of one of the suspension base strap or the elastic/static component connected with the handle and an end of the other of the suspension base strap or elastic/static component connected with an anchor, whereby a user may selectively configure the training system to have an elastic component between the user and an anchor or have a completely inelastic strap configuration between the user and an anchor.

In a further aspect in accordance with the invention, the first and second ends of the elastic/static component are configured to receive both the inelastic segment and the elastic segment at the same time such that they are connected in parallel, and wherein the inelastic segment has a length that is shorter than a length of the elastic segment, whereby when both inelastic and elastic segments are connected in parallel to the first and second ends of the elastic/static component, the elastic segment is neutralized.

In yet additional aspects, the first end of the base strap is configured to connect with an anchor and the second end of the suspension base strap is configured to connect with the first end of the elastic/static component with an end of the elastic/static component connected with the user handle. An anchor connector comprises an anchor strap connector having a first end that is connected to an anchor and having a loop at a second end, wherein the base strap is threaded through the anchor strap loop with the first end and the second end of the suspension base strap located on opposite sides of the anchor strap loop.

In yet further aspects, the suspension base strap is adjustable in length. The elastic/static component is configured to receive a plurality of elastic segments connected in parallel with each other between the first and second ends, each of which is configured to be connected and disconnected individually from one or both ends to control thereby the level of elasticity within the component. The elastic/static component is configured to receive elastic segments having differing strengths of resistance between the first and second ends, each of which is configured to be connected and disconnected individually from one or both ends to control thereby the resistance level within the elastic/static component.

In even more detailed aspects in accordance with the invention, the elastic/static component comprises a housing having a connector, wherein the elastic segment comprises a plurality of elastic resistance bands, each of which has first and second ends, and at least one of which has a different resistance level than another of the plurality of resistance bands, wherein each resistance band has an easily releasable connector at one of its ends configured to connect to either the first or second end of the elastic/static component. The connector of the housing comprises one component of a hook-and-loop fastener and wherein the elastic segment comprises the other component of the hook-and-loop fastener whereby when the fastener component of the elastic segment is mated with the fastener component of the housing, the elastic segment is held firmly at the housing.

In yet other aspects, the (more on mounting the elastic resistance bands to the first and second ends). The strength training system further comprises a cover located at the elastic/static component configured to surround the elastic segment, the cover configured to be openable when desired. The housing includes a snap connector configured to connect with a complementary connector located on a user handle for easily and firmly se curing the handle to the elastic/static component. The suspension base strap includes a loop located between the first and second ends, the loop configured to receive an anchor strap to secure the suspension base strap to an anchor.

In yet more aspects, the strength training system comprises a door anchor strap configured to extend about the top, front, bottom, and back of a door, making the door operate as an anchor, double opposing locking cam buckles slidable along the door anchor strap to a selected location along the door, and locking at the selected location, wherein each of the cam buckles firmly grasps the door anchor strap when pulled in a predetermined direction with enough force to hold the buckle in place sufficient to hold the weight of a user for exercising; and an anchor strap connected with the double opposing locking cam buckles configured to receive the suspension base strap.

In aspects of a method in accordance with the invention, there is provided a strength training method for conditioning the strength of a user, the strength training method comprising securing an elongated suspension base strap formed of inelastic material to an anchor, the suspension base strap having an end, connecting an elastic/static component having a first end and a second end to the end of the suspension base strap, selecting either an inelastic segment as the elastic/static component or an elastic segment as the elastic/static component, in the case where an elastic segment has been selected, further select at least one resistance band having a desired level of resistance from a housing having a plurality of resistance bands that forms a part of the elastic/static component, in the case where an elastic segment has been selected, connect the selected elastic band or bands between the first and second ends of the elastic/static component, connect a user handle to the end of the elastic/static component, whereby a user may selectively configure the training system to have an elastic component between the handle and the anchor or have a completely inelastic strap configuration.

DETAILED DESCRIPTION OF THE PREFERRED EMBODIMENTS

In general, the present invention provides a combination elastic and inelastic exercise system and method that is highly versatile and portable and can be easily attached to a supporting structure, and that allows a user to perform a large number of exercises by easily adjusting the length of the device and selecting the configuration of an elastic/static component. The inelastic or static portion of the system and method permits suspension training while the elastic portion permits a wider range of ground-based exercises. As used herein, "ground based" includes any exercise that can be performed from a standing position but in this case the elastic portion allows for resistance training that comes from any height level. Suspension training is generally all from above. The elastic portion allows for strength training movements to be performed from low to high positions and anywhere in between. For example, an exercise from a low position such as squats with a shoulder press combination move can be done with the elastic device. As another example, a chest press can be done from a middle height with an elastic device, and as a last example, latissimus pull-downs from a position above the user's height can be done with an elastic device.

Elastic bands also allow for progressive resistance (lighter to heavier) in each exercise. The beginning stretch portion of an elastic band is easier than the end stretch portion whereas in suspension training, it remains constant.

Figure 1:
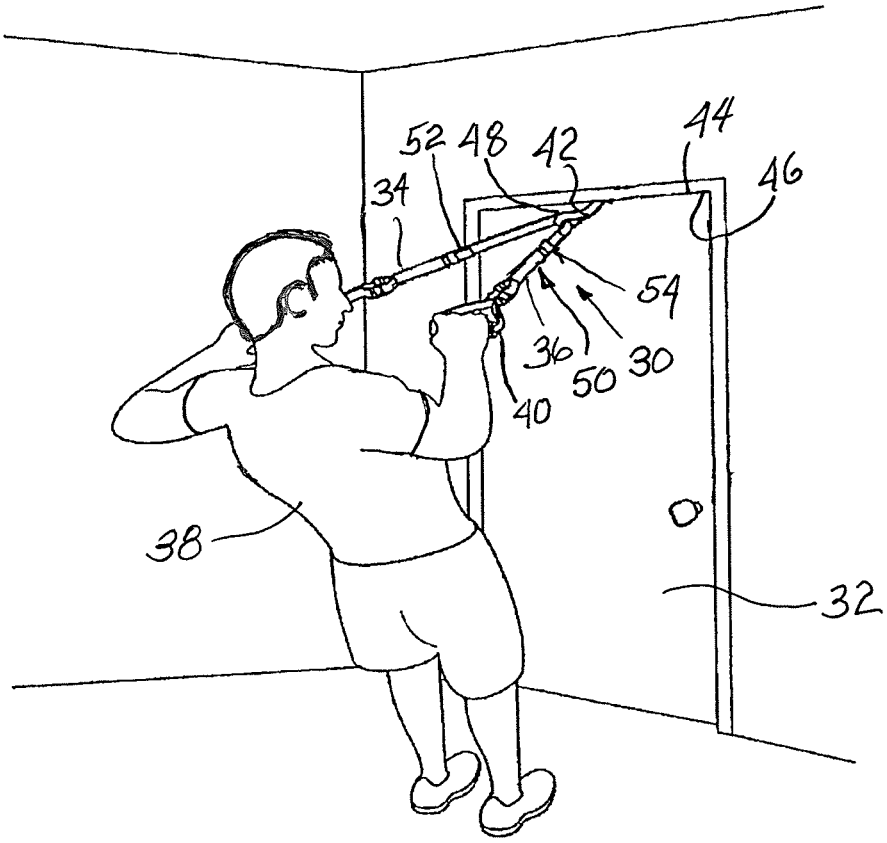
FIG. 1 presents a view of an existing suspension exercising device that uses the door as an anchor and has two base straps for suspension of the user. The user has gripped the handles of the two strap segments with respective hands, leaned back to suspend himself against gravity, and is pulling himself towards the handles using arm muscles for muscle strengthening.
Figure 2:
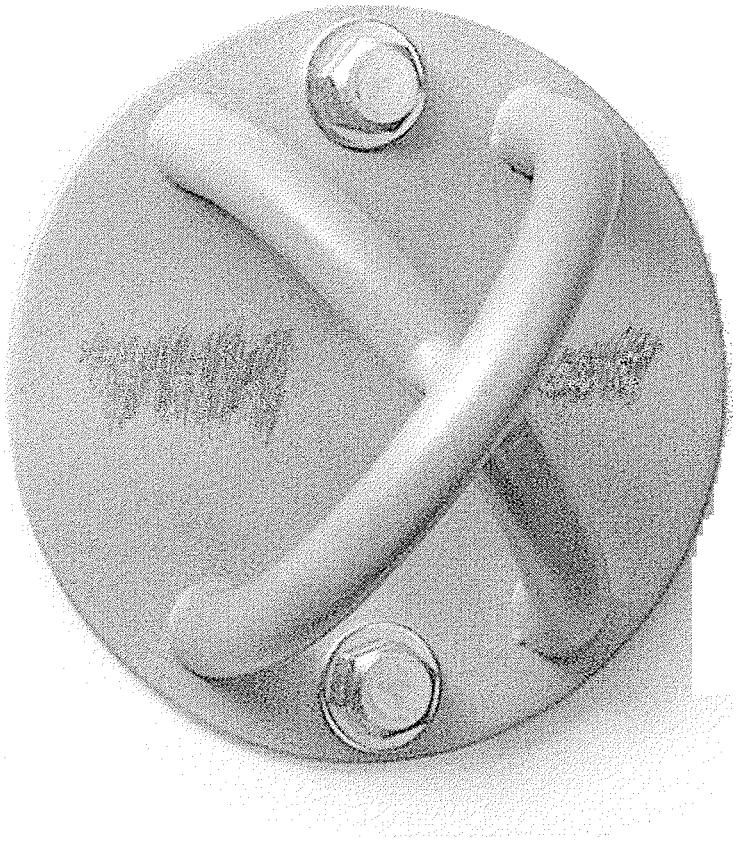
FIG. 2 is a view of a commercially available fixed anchor through which a suspension strap may be threaded or to which an anchor loop may be mounted through which a suspension strap may be threaded for use by an exerciser, in this case the anchor is bolted to a wall, or post, or other substantial structure suitable to hold the entire suspended weight of an exerciser.
Figure 3:
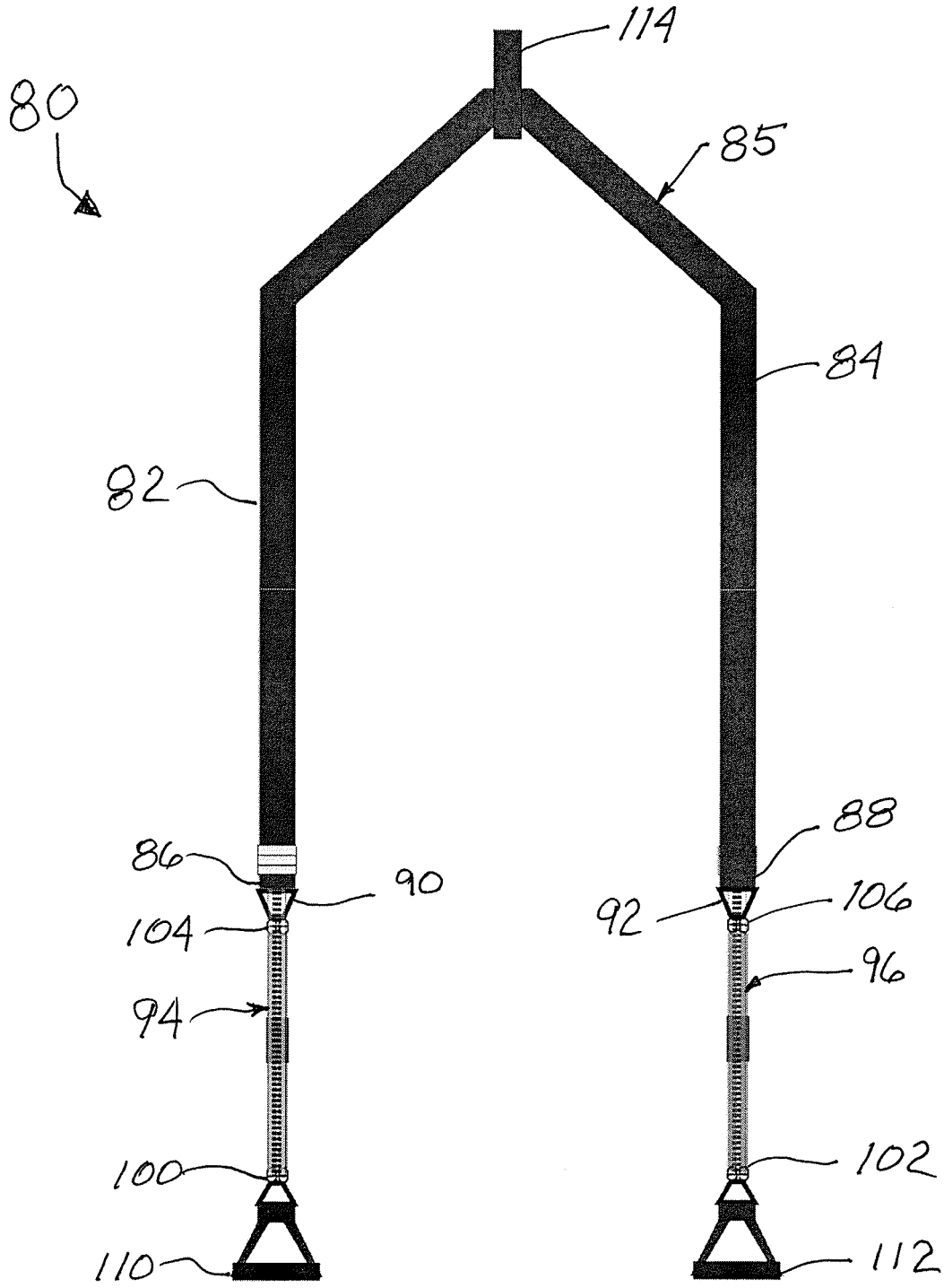
FIG. 3 is a schematic-type drawing of a strength training system having a base suspension strap threaded through an anchor loop to form two suspension segments in which an elastic/static component in accordance with principles of the invention is mounted at each end of the respective strap segments, the system also having handles in this embodiment for gripping or engagement by a user's hands or feet.

Now continuing to refer in detail to the drawings, in which like reference numerals indicate like or identical elements among the views, there is shown in FIG. 3 a block, schematic diagram of a strength training system 80 and method having elastic resistance and suspension devices for use in strength training. Elongated elastic/static components 94 and 96 are connected between elongated suspension base straps 82 and 84 and user handles 110 and 112 by means of D-rings or other suitable connectors. The elongated suspension base straps 82 and 84 may be made of nylon webbing, rope, metal cable, chain, or the like and may or may not be adjustable in length. The adjustable length of the suspension base straps may be controlled by a cleat, buckle, or some other length-adjusting device system (not shown). The suspension base straps have respective ends 86 and 88 with each end having a fixed or releasable connector 90 and 92 that is used to connect the suspension base straps ends to upper ends of respective elastic/static components 94 and 96. The connector may consist of a buckle, ring, hook, clip, or the like that securely attaches the base straps to the respective elastic/static components as shown.

It will be seen that the elastic/static components 94 and 96 are connected to the suspension base straps 82 and 84 at the respective upper ends 104 and 106 of the elastic/static components. The elastic/static components 94 and 96 each have lower ends 100 and 102, which are connected to respective user handles 110 and 112 respectively. These handles may have many different shapes and may be formed to accommodate the hands or feet of a user, as well as other body parts. At the top of the figure, part of an anchor connecting strap 114 is shown. Anchor connecting straps will be discussed in more detail below in conjunction with other figures. In this embodiment, the anchor connecting strap 114 effectively divides the single length of a suspension strap 85 into two suspension base straps 82 and 84, located on either side of the anchor connecting strap; however, in other embodiments, the suspension base straps may be separate individual straps that are individually connected to the anchor connector strap 114.

Figure 4:
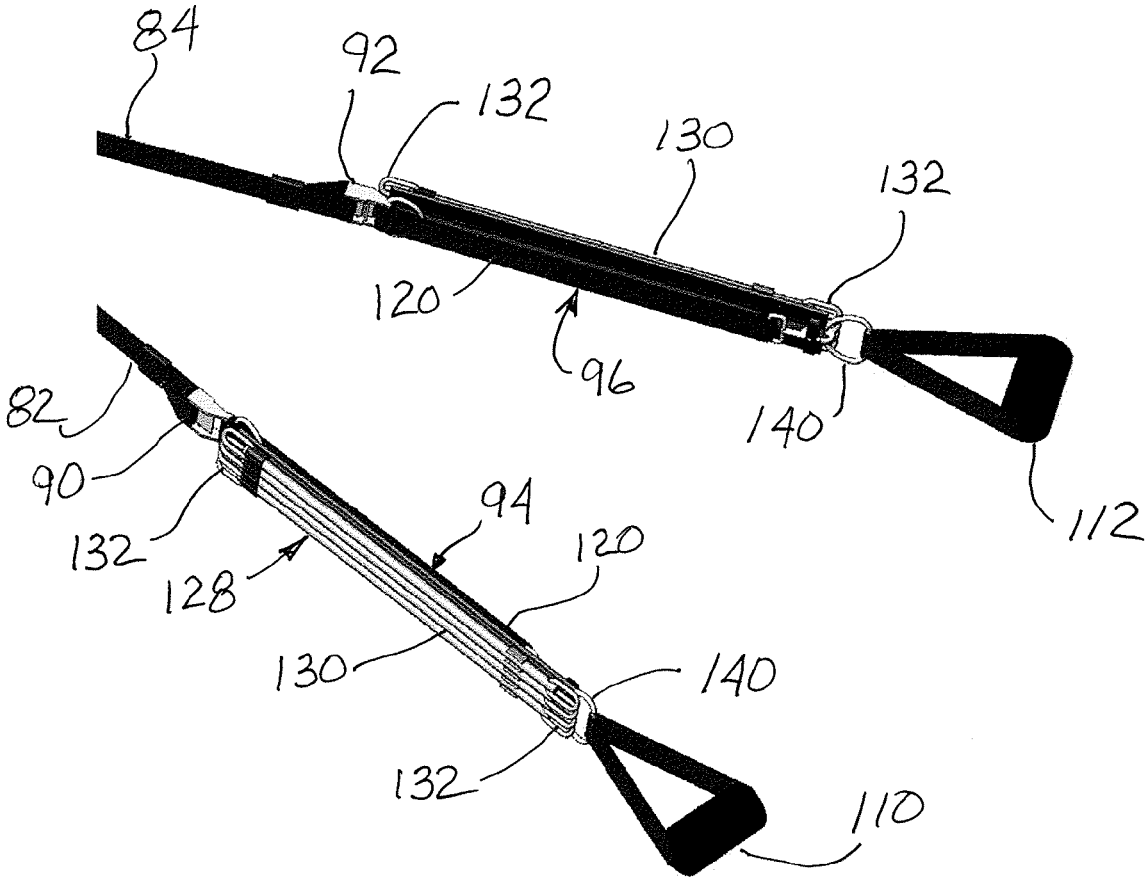
FIG. 4 shows the ends of the suspension strap segments of FIG. 3 in greater detail, particularly showing the connectable/disconnectable elastic component in the foreground and the connectable/disconnectable static (inelastic) component in the background.
Figure 5:
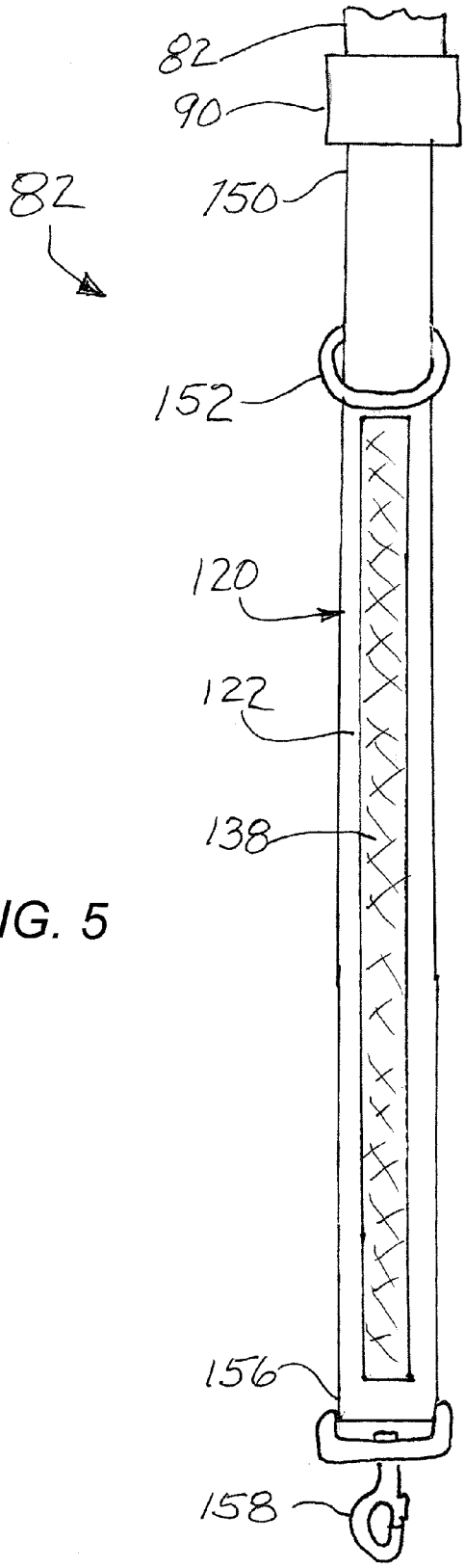
FIG. 5 shows detail of the connectable/disconnectable static (inelastic) component functioning as a housing and having a D-ring at the top to which the connectable/disconnectable elastic component may be connected (not shown) and a snap hook at the bottom to which a handle may be connected, the view also showing a longitudinal connector strip to which the connectable/disconnectable elastic component may be connected if used.
Figure 6:
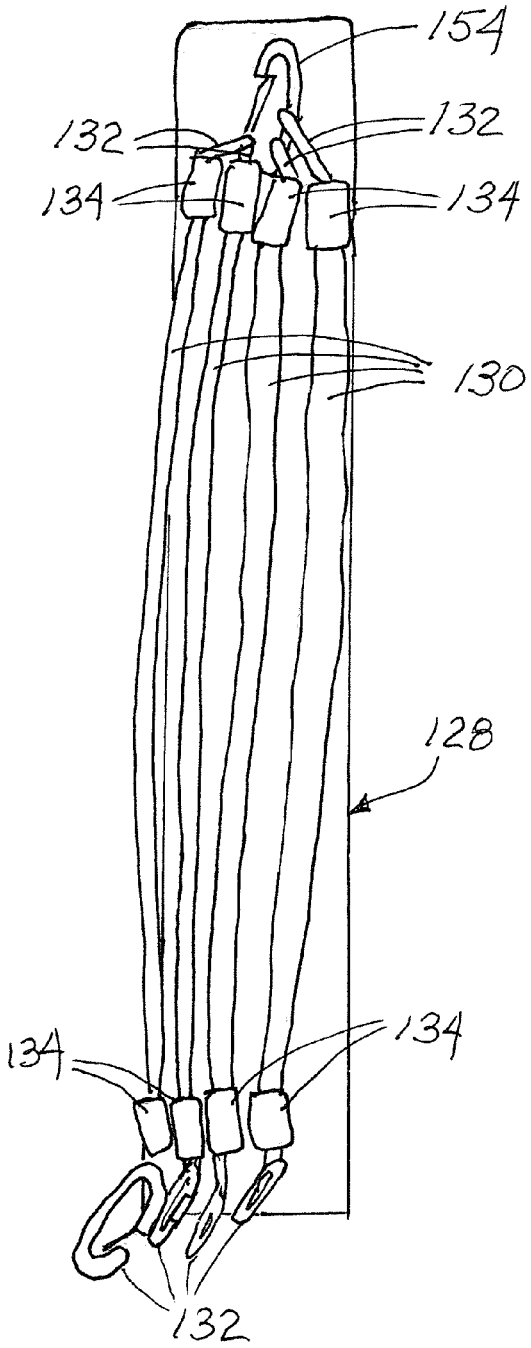
FIG. 6 shows detail of an embodiment of a connectable/disconnectable elastic component having a plurality of selectively connectable elastic exercise tubes each having carabineers at each end for selectively connecting each of the four to the D-ring shown in FIG. 5, the bottom of the elastic component (not shown) having a complementary connector for connecting to the static component, thus providing a modular approach.

In FIGS. 4, 5, and 6, further details of the elastic/static components 94 and 96 are shown. In this embodiment, each of the connectors 90 and 92 between respective suspension base straps and the elastic/static components comprise a buckle that allows for adjusting the length of the respective suspension base strap 82 and 84. In the embodiment shown, the elastic/static components have a modular form. A housing 120 is provided that consists of an inelastic strip 122 upon which is mounted an elastic band module 128, which in this case, comprises four elastic exercise bands 130, each of which has connectors 132 mounted at each end (FIGS. 4 and 6). The elastic band module also includes loop guides 134 through which an elastic band is mounted. In this embodiment, there are loop guides at both ends of the elastic band module, although other arrangements may be used. The loop guides work to keep each elastic band mounted firmly to the elastic band module 128, as well as facilitate holding the particular band in position to assist a user in connecting the particular band to the suspension base strap and the handle connector 140 (FIG. 4). In FIG. 4, the elastic band modules 128 have been properly mounted to their respective housings 120. FIGS. 5 and 6 show the housing 120 and the elastic band module 128 separately.

Turning now to FIG. 5 in more detail, the housing 120 formed of an inelastic strip of material 122 includes a connector 138 mounted to a top surface. In this case, the connector 138 comprises a hook-and-loop type, often referred to by the trademark Velcro™. One of the hook-and-loop components, such as the loops, are firmly mounted to the housing while the other component of the hook-and-loop connector, such as hooks, is mounted to the bottom surface (not shown) of the elastic band module 128. Upon assembly of the elastic band module with the housing, the two connector components are pressed together and the configuration shown in FIG. 4 results. Other connection methods of the housing with the elastic band module are possible. It will be noted that through this means of a modular approach, different elastic band modules may be used. Some may have elastic bands of higher resistance or lesser resistance than others, some may have shorter or longer bands than others. The modular design results in increased versatility.

As shown in FIG. 6, the upper end 150 of the housing includes a D-ring 152 in this embodiment. This D-ring connector is used to connect with one end of the elastic bands 130 of the elastic band module. FIG. 6 shows that the upper connectors 132 of all the elastic bands 130 are all connected together to a carabineer connector 154. This carabineer connector can be connected to the D-ring 152 of the housing thereby connecting the upper ends of all the elastic bands to the housing. At the lower end of the housing 156, a snap hook 158 is mounted for connecting to the connector 140 of a user's handle 110 (FIG. 4). Alternatively, the lower connectors 132 of the elastic bands may be connected to the connector 140 of the handle. FIG. 4 however shows that only the snap hook 158 of each housing is connected to the connectors 140 of the handles 110 and 112. Thus the system shown in FIG. 4 is completely inelastic and is useful for suspension training. If the user wished to use the elastic bands to engage in strength training, the snap hook 158 would be disconnected from the connectors 140 of the handles and one or more of the elastic band's connectors 132 would be connected to the connector 140 of the handles. To see the effects of connection/disconnection of the various devices in the elastic/static component, the table below has been furnished:

| Elastic Component | Inelastic Component | Elastic/Static Component |
|---|---|---|
| connected | not connected | elastic |
| not connected | connected | inelastic |
| connected | connected | inelastic |

In the embodiment of FIGS. 4, 5, and 6, the housing length between the buckle 90 at the suspension base strap 82 and the snap hook 158 is shorter than the length of the elastic bands 130. Thus if the snap hook is connected to the user handle 140, the elastic bands will be neutralized. Another advantageous feature of the arrangement shown in FIGS. 4, 5, and 6 is that should the user want to have an elastic strength training session, he or she need only connect one or more elastic bands 130 to the handle's connector 140 and disconnect the snap hook 158 from the handle's connector. This is shown schematically in FIG. 8. The remaining unconnected elastic bands remain in place due to the loop guides 134 and can be connected to the user's handle at any time. If the user is done with the elastic band training session, he or she need not disconnect each and every elastic band from the user's handle connector. Instead all the user need do is to connect the snap hook 158 to the user's handle connector 140 and all elastic bands are neutralized.

To reiterate, the elastic/static component 94 consists of both elastic and inelastic elongated segments. Elastic segments are linear elastic exercise bands 130, in this embodiment, and may be rubber exercise bands, exercise tubing, bungee cords, springs, or the like. The inelastic segment 122 is found as the housing 120 and is linear and may be formed of any of nylon webbing, rope, metal cable, chain, or the like. The static piece or pieces may be of fixed length or, in another embodiment, may be adjustable in length.

FIG. 6 shows detail of an embodiment of a connectable/disconnectable elastic component 128 having a plurality of selectively connectable elastic exercise tubes 130 each having carabineers 132 or other suitable connector at each end for selectively connecting each of the four to the D-ring 152 of the housing as shown in FIG. 5.

Figure 7:
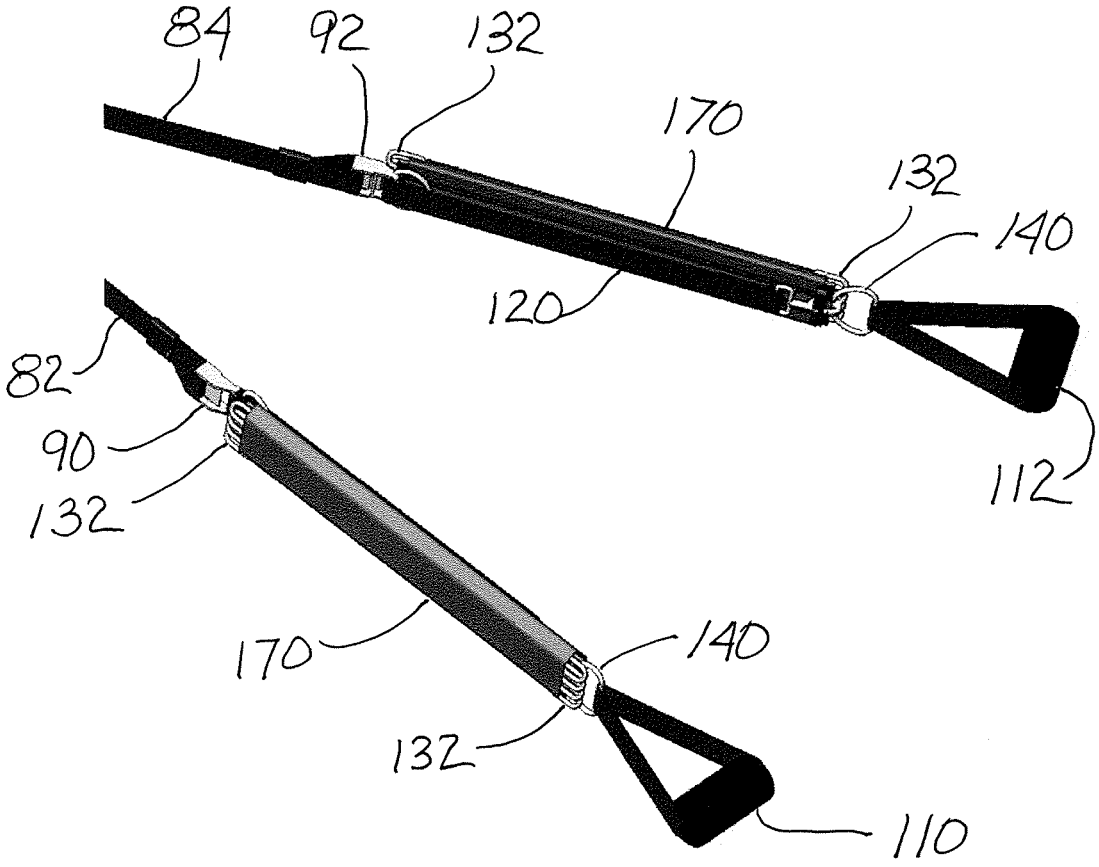
FIG. 7 shows the components of FIGS. 5 and 6 connected together and shrouded by a cover, and further showing cam buckles in the base suspension segments controlling the length of the system.

Turning now to FIG. 7, the view is similar to FIG. 4, except that a cover 170 has been placed over the elastic bands module 128. This cover 170 holds the elastic bands 130 in position for use and avoids any inadvertent engagement with an elastic band that may pull it out of the module 128 making it unavailable for use. The cover may be formed of any resilient, flexible fabric-like material, for example, canvas, neoprene, or similar materials and can be formed as a closed sleeve into which the elastic bands module 128 is slid for use, or can be a wrap-around sleeve over the elastic bands module 128 and closed with a hook-and-loop closure device, such as that described above. The seam for the closure device can be located lengthwise along the sleeve (not shown). Other arrangements are possible.

Figure 8:
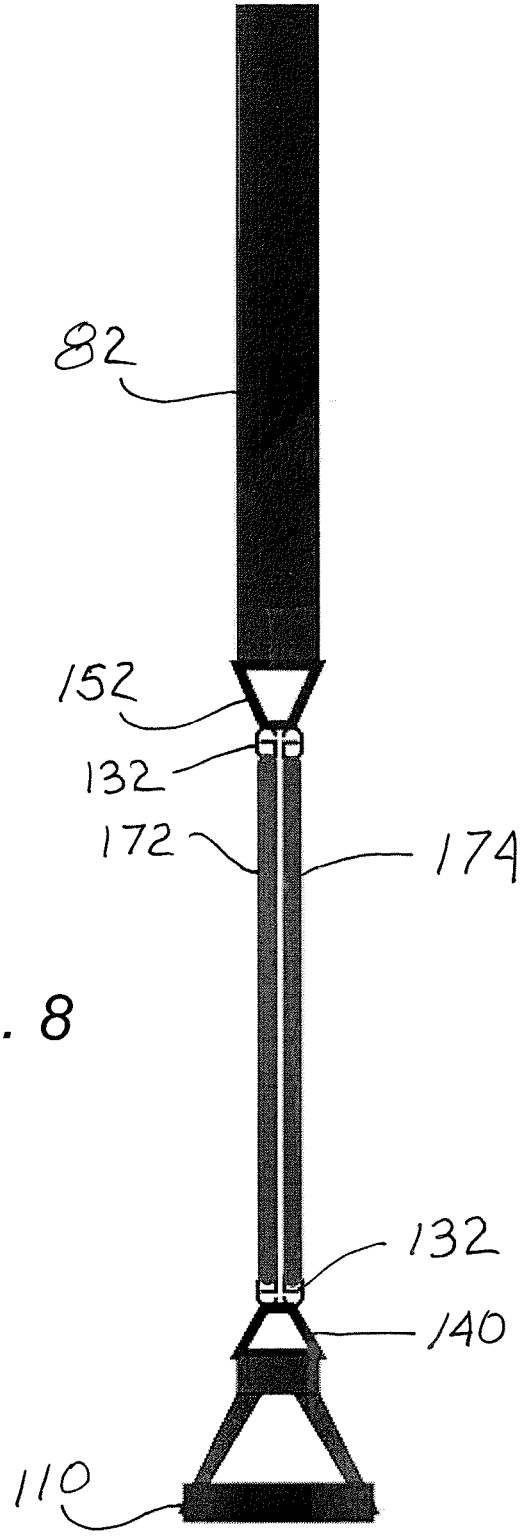
FIG. 8 is an enlarged view of the elastic/static component showing details of two of the elastic tubings with the outer housing removed.

FIG. 8 shows a schematic diagram of when two elastic bands 172 and 174 are effectively connected between the suspension base strap 82 and a handle 110. The housing 120 has been eliminated in this view for clarity of illustration. Referring briefly to FIG. 4, the housing has the D-ring connector 152 to which the elastic bands are connected at their upper ends. The snap hook 158 of the housing has been disconnected from the connector ring 140 of the handle 110, and the bottom connectors 132 of the elastic bands 172 and 174 have been connected directly to the connector 140 of the handle. Thus, the inelastic strip of the housing 122 is not connected between the handle and the suspension base strap 82 effectively making the strength training system and method having elastic resistance and suspension devices an elastic training device between the handle and the anchor. More, or fewer, elastic bands can be connected between the suspension base strap 82 and the handle 110 as desired. In FIG. 6, an elastic bands module is shown having four elastic bands 130; however, more or fewer elastic bands may be included in such a module in other embodiments.

Figure 9:
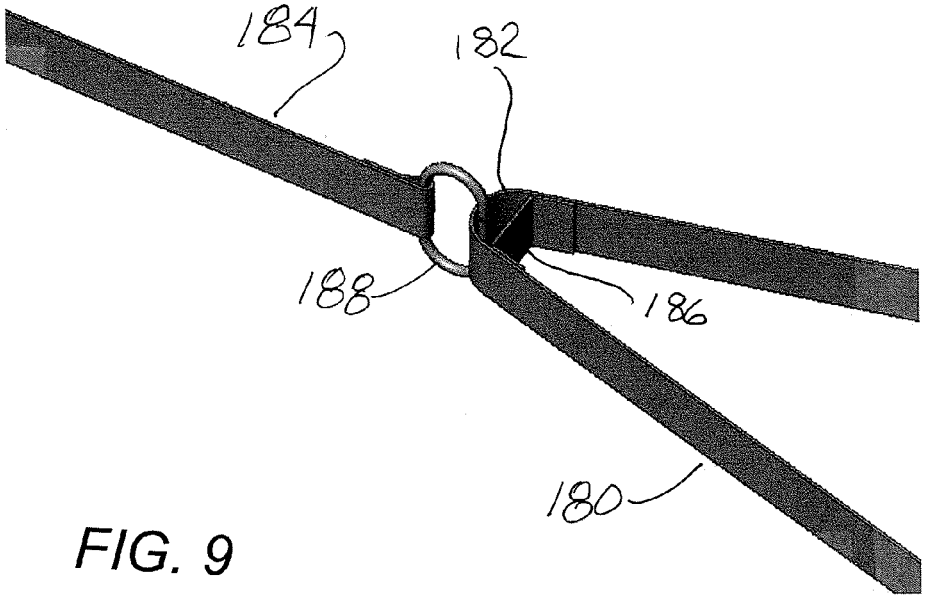
FIG. 9 is a view of an embodiment of the anchor loop with the strap threated through it, showing that the strap itself also has a loop that attaches to the loop of the anchor so that the strap segments will be equal in length and the strap will not be movable through the anchor loop.

FIG. 9 is a view of an embodiment of a suspension base strap 180 having a base strap loop 182 fixed in the strap to engage an anchor strap 184. A loop insert 186 is attached to the based strap 180 at two separate areas to form the loop 182. In this case, the loop insert is shorter than the distance between the two attachment points on the base strap thus resulting in a loop 182 having a size that is large enough to receive the connector ring 188. The connector ring 188 may be permanently mounted in the loop 182 as part of the base strap 180 and the anchor strap 184 may have a connector to connect with it. In another embodiment, the connector ring 188 may be permanently mounted to the anchor strap 184 and connect with the suspension base strap 180 at the loop 182 when needed.

The loop insert 186 in one embodiment is formed of the same material as the base strap 180 and is permanently affixed in the base strap 180, such as by being sewn to the base strap at the two ends of the loop insert. In another embodiment, the loop insert can be permanently affixed at one of its ends to the base strap 180 with the other end of the loop insert being loose but attachable to the base strap at a selected point through the use of a connecting device, such as a hook-and-loop connector described above. In this embodiment, the base strap 180 would have one component of the hook-and-loop connector, such as the loops, sewn into the base strap while the loop insert has the complementary component of the connector, such as the hooks, sewn into the loose end of the loop insert. In the case where the connector ring 188 is a part of the anchor strap 184, an end of the base strap would be threaded through the connector ring 188 and when the ring is at the loop insert, the loose end of the loop insert would then be placed over the ring and the hooks component engaged with the loops component on the base strap. Connectors other than a hook-and-loop type may be used and needed depending on the weight to be supported by the loop insert.

The base strap loop 182 is useful to divide effectively the base strap 180 into two base strap segments, such as shown in FIG. 3 by numerals 82 and 84. Making the base strap loop 182 with a strength equal to the base strap itself results in the ability to only use one handle with the anchor, if desired, resulting in more versatility. In one embodiment, the base strap loop 182 is position halfway along the length of the base strap 180 so that two equal-length base strap segments result. Other embodiments are possible depending on the application desired for the training system.

Figure 10:
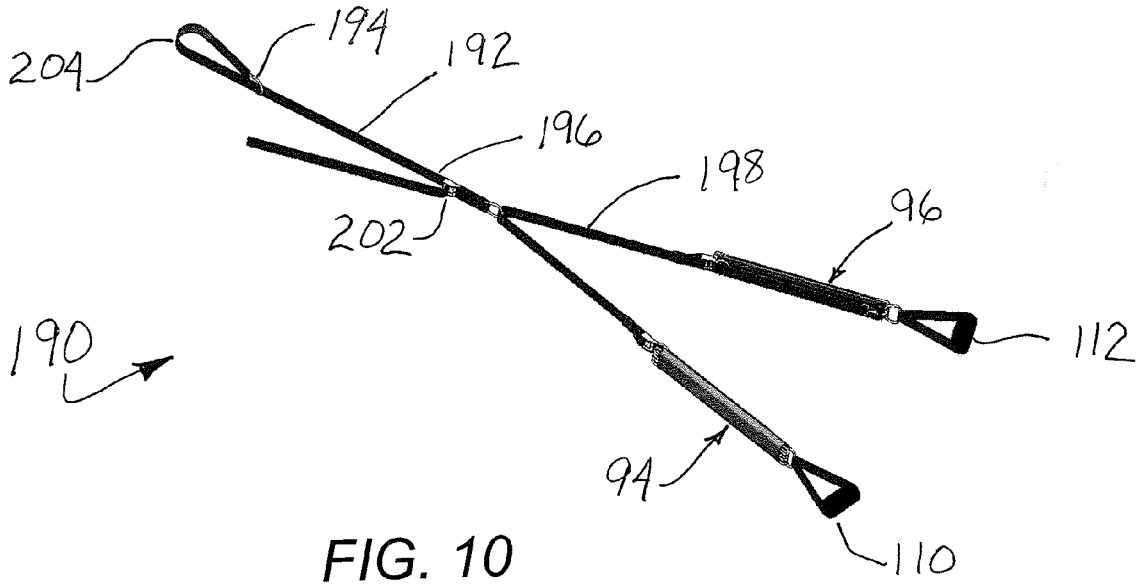
FIG. 10 is a view similar to FIG. 9 showing a view of an alternative design for an anchor strap having a loop at one end for engaging the anchor, such as that shown in other figures below, and an adjustable buckle to permit lengthening or shortening the anchor strap, and a D-ring or oval-ring or other connector at the terminal end.

FIG. 10 presents a full view of a strength training system 190 having elastic resistance and suspension devices in accordance with aspects of the invention. The view shows an anchor strap 192 having two ends, a first end 194 for engaging an anchor (not shown) and a second end 196 for engaging the suspension base strap 198. In this embodiment, the anchor strap 192 includes two connectors, a ring 200 for forming a loop 204 at the first end of the anchor strap, the size of which is adjustable with the ring. The ring permits the user to wrap the anchor strap completely around an anchor structure, such as a tree limb, and then feed it through the ring and then into the buckle 202 to anchor the entire system to the tree limb. This increases the versatility of the system 190 in that it can be used with a wider variety of anchors, some of which would be impossible to engage unless the end of the anchor strap 192 could be wrapped around the anchor device as described.

The buckle 202 allows the user to lengthen or shorten the anchor strap 192, depending on how far away from the anchor the user desires to be. This also greatly increases the versatility of the system. Such buckles are standard strap buckles and may be obtained from numerous sources. Because they are so well known in the art, no further details are provided here.

Figure 11:
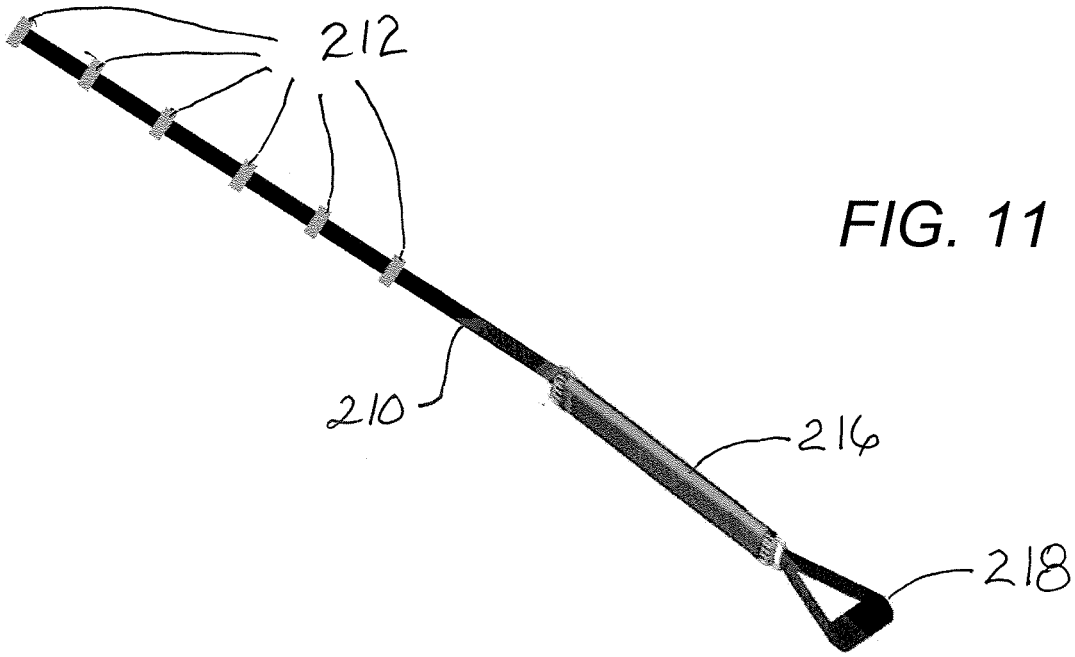
FIG. 11 is a view of an alternative design for an anchor strap having a D-ring at the terminal end for engaging the elastic/static component, and spaced-apart dowels mounted in the base strap for being placed behind an closed door and door jamb to provide an anchor structure for exercises with the system shown.

FIG. 11 is a view of an alternative design for an anchor strap 210 in which dowels 212 are mounted onto the strap 210 at set intervals. The strap 210 functions both as a suspension base strap and an anchor strap. The dowels are particularly useful when making a door an anchor by positioning the anchor strap between the top of the door and the lintel. The dowel is larger in diameter than the clearance between the top of the door and the lintel and thus the anchor strap is held firmly in position. The need for a length-adjusting cam buckle is obviated by the plurality of dowels at predetermined positions along the length of the base/anchor strap 210. Plastic dowels were used in one embodiment and they were spaced from between six inches (15.24 cm) to twelve inches (30.48 cm) apart. In one embodiment, a five foot (152 cm) length of doweled anchor strap was provided. In this embodiment, the anchor strap 210 turns into a suspension base strap at a certain point and the elastic/static component 216 is connected to it, and in turn, a handle 218 is connected to the elastic/static component. This embodiment therefore is useful with a single handle 110. However, those skilled in the art will likely instantly note that the embodiment shown in FIG. 3 may also be used with the anchor strap 210 shown and described here.

Figure 12:
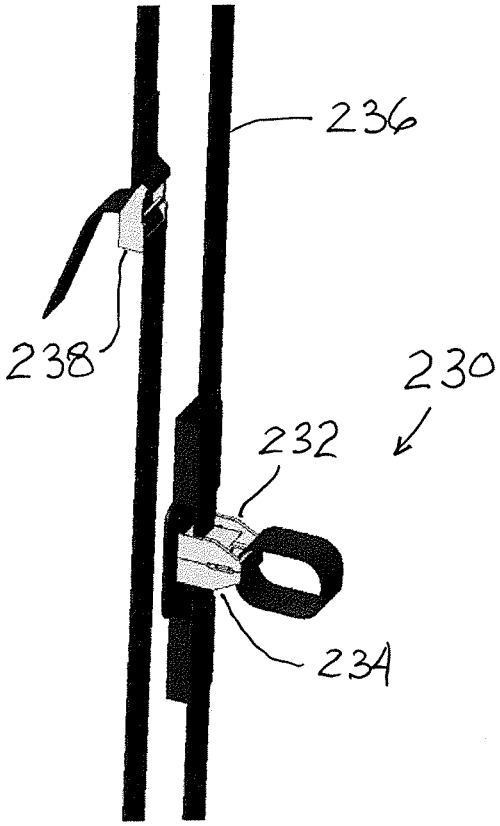
FIG. 12 is a diagram showing the use of a cam buckle on an anchor strap to establish an anchor point on the strap, the cam buckle having an anchor connector strap having a loop to which a suspension base strap may be connected.
Figure 13:
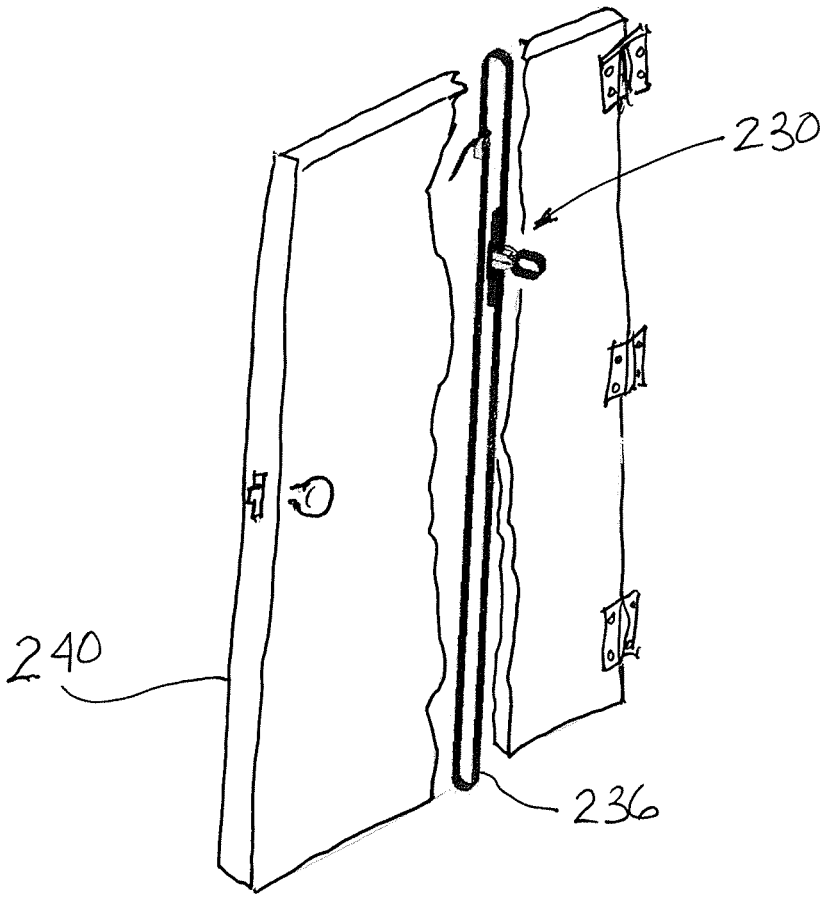
FIG. 13 shows an anchor strap mounted lengthwise on a door to establish the entire door as the anchor structure and an anchor point device comprising opposing cam buckles mounted to the anchor strap that allows the anchor point to be located at the bottom of the door, or at the top of the door, or anywhere in between to provide support for various resistance exercises requiring an anchor point either above, level with, or below the user.

Turning now to FIG. 12, a diagram of an anchor point device 230 comprising double-opposing locking cam buckles 232 and 234 is shown in which the cam buckles are mounted to an anchor strap 236 near each other. The anchor strap has a length-adjusting buckle 238 at its end. The purpose of the anchor point device 230 is to establish an anchor point on an anchor strap from which the user of the strength training system in accordance with the invention may perform strength training One application of such an anchor point device 230 is shown in FIG. 13 in which the anchor strap 236 is wrapped vertically about a door 240 thus turning the door into an anchor. Then, the double-opposing locking cam buckles 232 and 234 may be slid up or down the anchor strap 236 from the bottom to the top of the door 240 or vice versa, to establish an anchor point anywhere along the entire length of the door. This results in great versatility in that the user may have an anchor point at the very bottom of the door from which to perform exercises pulling upwards, or may establish an anchor point at the very top of the door from which the user may perform exercise in which he or she is pulling in a downward direction. An anchor point may also be established in accordance with the very height of the user. For example, this device permits a user to establish an anchor point at shoulder level to that user.

To avoid sliding or rotation of the anchor strap 236 about the door when a user pulls on the anchor strap during strength training, means may be used to prevent such rotation. In one embodiment, the material of the anchor strap is doubled back over itself near the top of the door so that is will be firmly pressed between the top of the door and the lintel and prevent sliding of the anchor strap even if large pulling pressures are applied to it. Other means to prevent sliding are possible.

The purpose of the anchor point device is to stay firmly in place on the anchor strap 236, no matter what forces are applied to it. For example, if an anchor point is established along the anchor strap at about the middle of the door, that anchor point must remain fixed no matter if forces are applied that pull on the anchor point upwards or downwards. Thus, the anchor point device must resist all forces that would tend to cause it to move from the selected anchor position.

Figure 14:
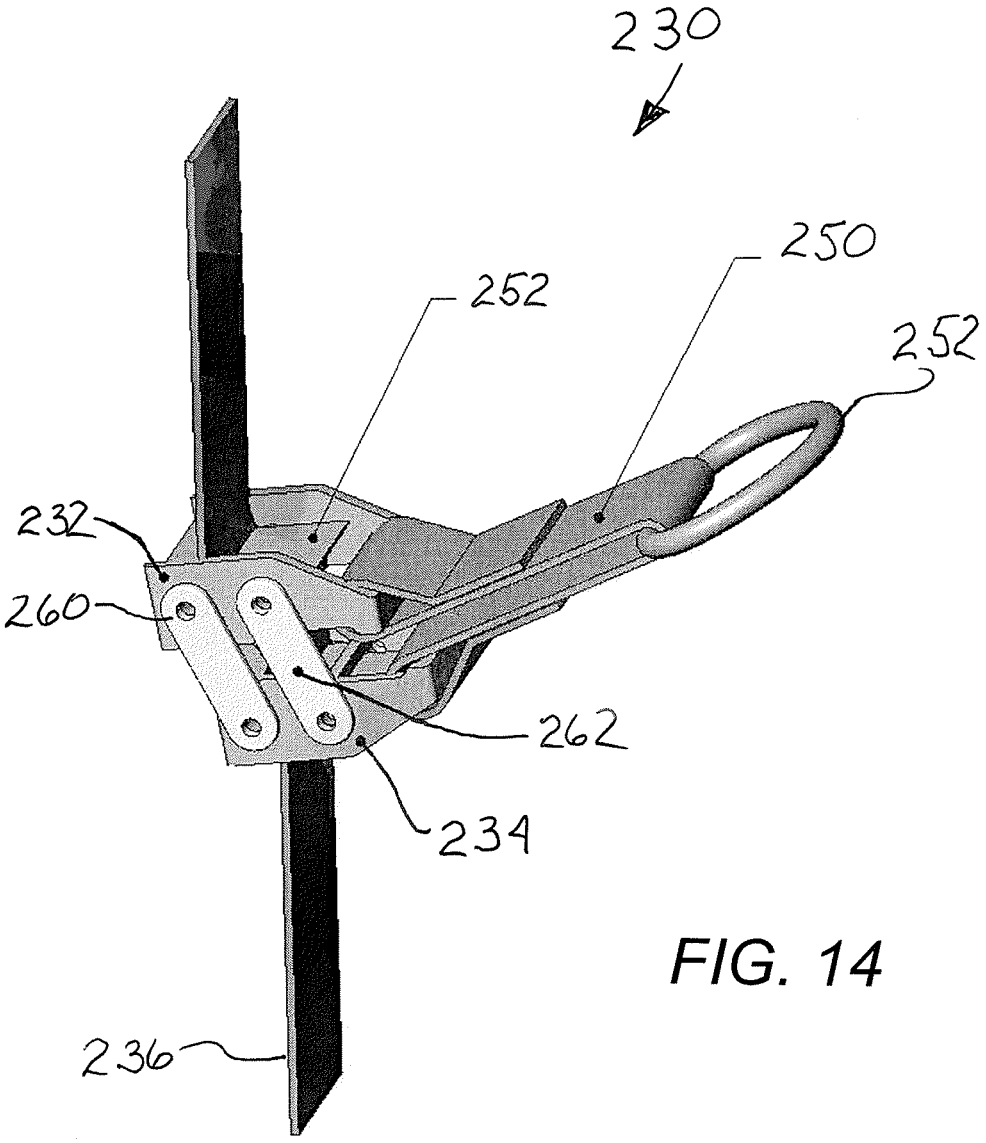
FIG. 14 shows details of an anchor point device comprising double-opposing locking cam buckles configured and oriented in accordance with aspects of the invention.

In FIG. 14, an embodiment of an anchor point device 230 is provided. In this embodiment, double opposing locking cam buckles 232 and 234 are used as the anchor point device. It will also be noted that the view includes an anchor connector strap 250 attached to both of the cam buckles. That anchor connector strap includes a connecting ring 252 that is used to attach to a suspension base strap or straps (not shown) such as that shown in FIG. 3. In this case, both locking cam buckles 232 and 234 are of the design whereby they can move freely along the anchor strap in one direction but their locking cam, or cleat, prevents movement of the locking cam buckle in the opposite direction. Therefore two of them are used but are mounted on the anchor strap so that they "oppose" each other. One will freely slide along the anchor strap towards the other one but that other one blocks movement in that direction. They are thus used in tandem to establish firmly an anchor point on the anchor strap 236. Because they are tied together with the same anchor connector strap 250, they operate as a single device; i.e., an anchor point device.

Standard types of cam buckles 232 and 234 may be used in which a spring-loaded locking cleat 252 is forced against the anchor strap 236 with a force large enough to support the weight of a user. The locking cleat 252 is formed at an angle so that the cam buckle is free to move along the anchor strap in one direction but resists movement along the anchor strap in the opposite direction. In the drawing of FIG. 14, a first cam buckle 232 is disposed at the top of the anchor point device 230 and a second cam buckle 234 is disposed below the first cam buckle 232 opposing the first cam buckle 232. The first, or top, cam buckle permits free movement of the buckle downward but prevents movement of the first cam buckle upward. The second cam buckle 234 is oriented exactly opposite ("opposing") to the first cam buckle in that the second cam buckle permits free movement upward but prevents movement downward.

Each cam buckle 232 and 234 has a slot for receiving the anchor strap 236 to thereby slide along the anchor strap. Each cam/cleat 252 has a lever action that is spring-controlled and will be automatically engaged against the anchor strap unless manually disengaged. This controlled levering of the cam/cleat by a spring, or some other spring-like method, will automatically engage the cam/cleat to the anchor strap thus locking the cam buckle in place on the anchor strap. The portion of the cam/cleat piece that will engage the strap may be textured such that it grips the anchor strap securely. Each cam buckle also has the cam/cleat that can be manually released by pressing down on it by a finger or the like. However, in this embodiment there are two cam buckles facing each other. The cam/cleat of each one must be pressed to release the cam/cleat piece from the anchor strap. Upon releasing the cam/cleat levers, they will automatically lock in place and be secure on the anchor strap in both opposing directions regardless of the pull direction. Thus once the anchor point device 230 comprising these double opposing locking cam buckles 232 and 234 is moved to the desired position and the cam/cleats 252 are let go, the anchor point device of this embodiment will be firmly set in the selected position and will support the user's weight in performing the strength training desired. The anchor point device of this embodiment also provides great versatility in that it allows establishing a selected anchor point for a user of the strength training system and method in accordance with the invention.

Because these locking cam buckles 232 and 234 are separate devices, they will operate on separate points of the anchor strap 236. The anchor strap is flexible and bending may occur. Additionally, the separate locking cam buckles are tied together with the anchor connector strap 250. In this embodiment, the two locking cam buckles are also secured together with four pivot able and rigid arms, two of which 260 and 262 can be seen in FIG. 14. Two other arms are mounted and oriented in the same fashion to the other side of the locking cam buckles. The arms may be formed of various materials including plastic, metal, or some other rigid material that will secure the buckles proximally together but leaving some spacing to allow them freedom in distance to offset enabling a tilting like motion with respect to the anchor strap 236 which will ensure the locking of the cam buckles onto the anchor strap. In the embodiment shown in FIG. 14 where two pivoting arms are used, a parallelogram effect results that allows the buckles to offset enabling the anchor connector strap 250 to tilt with respect to the anchor strap 236 and this assures that the cam buckles will remain locked in position on the anchor strap.

The anchor strap and anchor connecting strap can also act as an attachment point for other objects at the same time. For example a user could attach another strap to the opposing cam buckle system and rest assured that it will stay in place regardless of which direction it is being pulled. This would offer many possibilities for tying down loads or simply acting as an adjustable anchoring point to do anything the user wishes to use.

Furthermore, the anchor strap 250 connected with the double opposing locking cam buckles 232 and 234 can be a permanent connection with the buckles or can be releasably connected. In the latter embodiment, quick-release connectors may be used. The same feature can be applied in general to any anchor point in accordance with principles of the invention. The anchor strap can be permanently connected with an anchor or can releasably connected, in accordance with the invention.

In the embodiments herein, various connectors have been shown and described. However, other connectors may replace those shown and function just as well. Such connectors may comprise buckles, rings, hooks, clips, or other that securely attach components together. The handles may be made of nylon webbing, PVC, metal, or a combination thereof, or of other materials.

As shown and described above, the elastic/static mechanism components can easily be switched from elastic to inelastic or vice versa by simply attaching or releasing the inelastic component. Such attaching or releasing may be via a hook, clip, clasp, buckle, or other quick release device. When the inelastic component is connected to both the suspension base strap and the user's handle, it controls the elastic component. If the inelastic component is shorter than the elastic component, then when the elastic component is at a pre-stretched/relaxed length, the function of the elastic component is completely negated. If the inelastic component is longer than the elastic component, then when the elastic component is at a pre-stretched/relaxed length, the elastic component has the ability to stretch and provide progressive resistance until it reaches the length of the inelastic component. If the inelastic component is completely released from either the base strap, the user's handle or both, then the elastic component is fully operational.

Preferable connectors used in the system in accordance with the invention may include, but are not limited to, a hook, carabineer, buckle, strap, chain, or combination thereof. These devices permit quick connection and release allowing the system to be hooked up or free within seconds.

Although shown with the elastic/static component connected directly to a handle and the suspension base strap connected with an anchor strap, other configurations are possible. An elastic/static component may be located elsewhere between the handle and the anchor. Also, quick release connectors may be used in various places to facilitate rapid assembly or disassembly or swapping of components.

Certain embodiments of this invention are described herein, including the best mode known to the inventors for carrying out the invention. Variations on these described embodiments may become apparent to those of ordinary skill in the art upon reading the foregoing description. The inventor expects skilled artisans to employ such variations as appropriate, and the inventors intend for the invention to be practiced otherwise than specifically described herein in preferred embodiments. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A strength training system for conditioning the strength of a user through the use of a strap connected with an anchor, the training system comprising:

a first user handle configured to receive a body part of a user;

an elongated suspension base strap formed of inelastic material, the suspension base strap having an end;

an elastic/static component having a first end and a second end, the elastic/static component comprising:

an inelastic segment selectively connectable to the first end and the second end of the elastic/static component; and an elastic segment selectively connectable to the first end and the second end of the elastic/static component;

wherein when only the inelastic segment is connected to the first and second ends of the elastic/static component, the elastic/static component is inelastic, and wherein when only the elastic segment is connected to the first and second ends of the elastic/static component, the elastic/static component is elastic;

wherein the suspension base strap and the elastic/static component are connected together end to end with one of the suspension base strap and the elastic/static component connected with the handle and the other of the suspension base strap and elastic/static component configured to be connected with an anchor;

whereby a user may selectively configure the training system to have an elastic component between the user and an anchor or have a completely inelastic strap configuration between the user and an anchor.

2. The strength training system of claim 1 wherein the first and second ends of the elastic/static component are configured to receive both the inelastic segment and the elastic segment at the same time such that the segments are connected in parallel, and wherein the inelastic segment has a length that is shorter than a length of the elastic segment, whereby when both inelastic and elastic segments are connected in parallel to the first and second ends of the elastic/static component, the elastic segment is neutralized.

3. The strength training system of claim 1 wherein the first end of the suspension base strap is configured to connect with an anchor and the second end of the suspension base strap is configured to connect with the first end of the elastic/static component and the second end of the elastic/static component is connected with the user handle.

4. The strength training system of claim 1 further comprising an anchor connector comprising an anchor strap connector having a first end that is connected to an anchor and having a loop at a second end;

wherein the base strap is threaded through the anchor strap loop whereby the first end and the second end of the suspension base strap are located on opposite sides of the anchor strap loop.

5. The strength training system of claim 1 wherein the elastic/static component is configured to receive a plurality of elastic segments connected in parallel with each other between the first and second ends of the elastic/static component, wherein at least one of the elastic segments is configured to be connected and disconnected individually from one or both ends of the elastic/static component to thereby control the level of elasticity within the component.

6. The strength training system of claim 1 wherein the elastic/static component is configured to receive elastic segments having differing strengths of resistance between the first and second ends of the elastic/static component, wherein at least one of the elastic segments is configured to be connected and disconnected individually from one or both ends of the elastic/static component to thereby control the resistance level within the elastic/static component.

7. The strength training system of claim 1 wherein the elastic/static component comprises a housing forming the inelastic segment, and having a housing connector;

wherein the elastic segment comprises an elastic module coupled to the housing with the housing connector, the elastic module comprising a plurality of elastic resistance bands, each of which has first and second ends, and at least one band of which has a different resistance level than another of the plurality of resistance bands, wherein each resistance band has a connector at an end configured to connect to at least one of the resistance bands;

wherein the elastic module is disconnectable from the housing connector so that it may be replaced with another elastic module.

8. The strength training system of claim 7 wherein the connector of the housing comprises one component of a hook-and-loop fastener and wherein the elastic module comprises another component of the hook-and-loop fastener whereby when the fastener component of the elastic module is mated with the fastener component of the housing, the elastic module is held firmly at the housing.

9. The strength training system of claim 7 further comprising a sleeve located over the elastic module and configured to surround the plurality of elastic bands, the sleeve configured to be openable when desired.

10. The strength training system of claim 7 wherein the housing includes a connector configured to connect readily with a complementary connector located on a user handle for securing easily and firmly the handle to the elastic/static component.

11. The strength training system of claim 1 wherein the suspension base strap includes a loop located between the first and second ends, the loop configured to receive an anchor strap to secure the suspension base strap to an anchor.

12. The strength training system of claim 1 further comprising:

a door anchor strap configured to extend about the top, front, bottom, and back of a door, making the door operate as an anchor;

an anchor point device connected to the door anchor strap and movable along the door anchor strap to a selected location on the door anchor strap, and locking at the selected location; and an anchor connector strap connected to the anchor point device and configured to receive a suspension base strap.

13. The strength training system of claim 12 wherein the anchor point device comprises double opposing locking cam buckles slidable along the door anchor strap to a selected location along the door, and locking at the selected location;

wherein each of the cam buckles firmly grasps the door anchor strap when pulled in a predetermined direction with enough force to hold the buckle in place sufficient to hold the weight of a user for exercising; and wherein the anchor strap is connected with both of the double opposing locking cam buckles.

14. The strength training system of claim 1 further comprising:

a second user handle configured to receive a body part of a user;

a second elastic/static component having a first end and a second end, and comprising:

a second inelastic segment selectively connectable to the first end and the second end of the second elastic/static component; and a second elastic segment selectively connectable to the first end and the second end of the second elastic/static component;

wherein when only the second inelastic segment is connected to the first and second ends of the second elastic/static component, the second elastic/static component is inelastic, and wherein when only the second elastic segment is connected to the first and second ends of the second elastic/static component, the second elastic/static component is elastic;

wherein the elongated suspension base strap has a first end and a second end with the first end of the suspension base strap connected with the first elastic/static component and the second end of the suspension base strap connected with the second elastic/static component;

wherein the first elastic/static component is connected with the first handle and the second elastic/static component is connected with the second handle;

wherein the suspension base strap is configured to be connected with an anchor;

whereby a user may selectively configure the training system to have an elastic component between the user and an anchor or have a completely inelastic strap configuration between the user and an anchor.

15. The strength training system of claim 14 wherein the first and second ends of each of the elastic/static components are configured to receive both the respective inelastic segment and the elastic segment at the same time and wherein the inelastic segment has a length that is shorter than a length of the elastic segment, whereby when both the respective inelastic and elastic segments are connected to the first and second ends of the elastic/static component, the elastic segments are neutralized.

16. The strength training system of claim 13 wherein the anchor strap is permanently attached to the double opposing locking cam buckles and the anchor strap is permanently attached to the suspension base strap.

17. A strength training system for conditioning the strength of a user through the use of a strap connected with an anchor, the training system comprising:

a first user handle configured to receive a body part of a user;

a second user handle configured to receive a body part of a user;

an elongated suspension base strap formed of inelastic material, the suspension base strap having an end and configured to be connected with an anchor;

a first and a second elastic/static component each having a first end and a second end, the elastic/static components each further comprising:

an inelastic segment selectively connectable to the first end and the second end of each elastic/static component;

an elastic segment selectively connectable to the first end and the second end of each elastic/static component;

wherein when only the inelastic segment is connected to the first and second ends of each elastic/static component, each elastic/static component is inelastic, and wherein when only the elastic segment is connected to the first and second ends of each elastic/static component, each elastic/static component is elastic;

wherein the suspension base strap and the first and second elastic/static components are connected together end to end so that an elastic/static component is at either end of the suspension base strap;

wherein the first elastic/static component is connected to the first handle and the second elastic/static component is connected to the second handle; and an anchor connector comprising an anchor strap having a first end that is configured to be connected to an anchor and having a second end that is connected to the suspension base strap at a position between the first and second elastic/static components;

whereby a user may selectively configure the training system to have an elastic component between the user and an anchor or have a completely inelastic strap configuration between the user and an anchor.

18. The strength training system of claim 17 further comprising an anchor point device wherein the anchor point device comprises double opposing locking cam buckles slidable along the anchor strap to a selected location in regard to an anchor, and locking at the selected location;

wherein each of the cam buckles firmly grasps the anchor strap when pulled in a predetermined direction with enough force to hold the buckle in place sufficient to hold the weight of a user for exercising; and wherein the anchor strap is connected with both of the double opposing locking cam buckles.

19. The strength training system of claim 18 wherein the anchor strap is permanently attached to the double opposing locking cam buckles and the anchor strap is permanently attached to the suspension base strap.

* * * * *